United States Patent [19]

Ippolito

[11] 4,386,663

[45] Jun. 7, 1983

[54] COOLED JOURNAL BEARING

[75] Inventor: Rodolfo M. Ippolito, Euless, Tex.

[73] Assignee: Hughes Tool Company, Houston, Tex.

[21] Appl. No.: 238,258

[22] Filed: Feb. 25, 1981

[51] Int. Cl.[3] ..... E21B 10/18; E21B 10/22

[52] U.S. Cl. ..... 175/17; 175/227; 384/94

[58] Field of Search ..... 175/17, 227, 228, 229, 175/337, 359, 371, 372; 308/8.2, 76, 77, 107, 108

[56] References Cited

U.S. PATENT DOCUMENTS

| | | | |
|---|---|---|---|
| 2,037,967 | 4/1936 | DeCosta | 255/340 X |
| 3,374,039 | 3/1968 | Voorhies | 308/107 |
| 3,695,721 | 10/1972 | Jungel | 299/86 X |
| 3,720,274 | 3/1973 | McCallum | 175/372 |
| 4,035,039 | 7/1977 | Johansson et al. | 308/8.2 |
| 4,136,748 | 1/1979 | Dickerhoff | 175/337 |
| 4,167,219 | 9/1979 | McQueen | 175/229 |
| 4,206,952 | 6/1980 | Olschewski | 308/8.2 |
| 4,287,957 | 9/1981 | Evans | 175/17 |

*Primary Examiner*—Ernest R. Purser
*Assistant Examiner*—Thuy M. Bui
*Attorney, Agent, or Firm*—Robert A. Felsman; James E. Bradley

[57] ABSTRACT

An earth boring bit has a friction or journal bearing with features that allow cooling fluid to be circulated near the bearing. The bit is of the type having rotatable cutters carried by depending bearing pins. A bushing is stationarily mounted on the bearing pin, with the bushing's inner surface in contact with the outer surface of the bearing pin. One of the surfaces has a plurality of grooves that extend at least partially around the bearing pin. Passages are formed in the bearing pin and bit for circulating cooling fluid through the grooves. The cutter is mounted on the bushing in rotating and sliding contact to form a journal bearing.

8 Claims, 3 Drawing Figures

COOLED JOURNAL BEARING

BACKGROUND OF THE INVENTION

This invention relates in general to earth boring bits, and in particular to the bearings between the rotatable cutters and bearing pins.

A typical drill bit for drilling oil and gas wells has three rotatable cutters mounted on depending bearing pins. As the bit rotates, the cutters rotate on their respective bearing pins. Earth disintegrating teeth on the cutters disintegrate the earth formation to drill the well.

The bearings between the cutters and the bearing pin are subject to very large forces, resulting in heat generation and deterioration of the bearing. In general, there are two main types of bearings. One type of bearing uses a roller bearing, an example of which is shown in U.S. Pat. No. 3,720,274, Hugh F. McCallum, issued Mar. 13, 1973. The roller bearings are cylindrical bearings spaced between the cavity of the cutter and the bearing pin. The bit in that patent utilizes passages for circulating drilling fluid, normally air, between the roller bearings. Another type of roller bearing bit uses liquid lubricant such as grease in the roller bearing areas.

Another type of bit utilizes a friction or journal bearing, an example of which is shown in U.S. Pat. No. Re. 28,625, Robert A. Cunningham, reissued Nov. 25, 1975. In that type of bit, the cavity of the cutter mates in sliding and rotating contact with the bearing pin. In some embodiments, axially aligned grooves are placed in the bearing surfaces for containing a soft metal such as silver. Liquid lubricant such as grease is normally supplied from a reservoir that is sealed and pressure compensated to maintain the pressure in the bearing areas about the same as the exterior pressure.

For cooling, the journal bearing bit relies on drilling fluid circulated through nozzles to the exterior of the bit. While journal bearing bits are successful, increasing the life of the bearing by enhanced cooling is desirable.

DESCRIPTION OF THE PREFERRED EMBODIMENT

Figure 1:
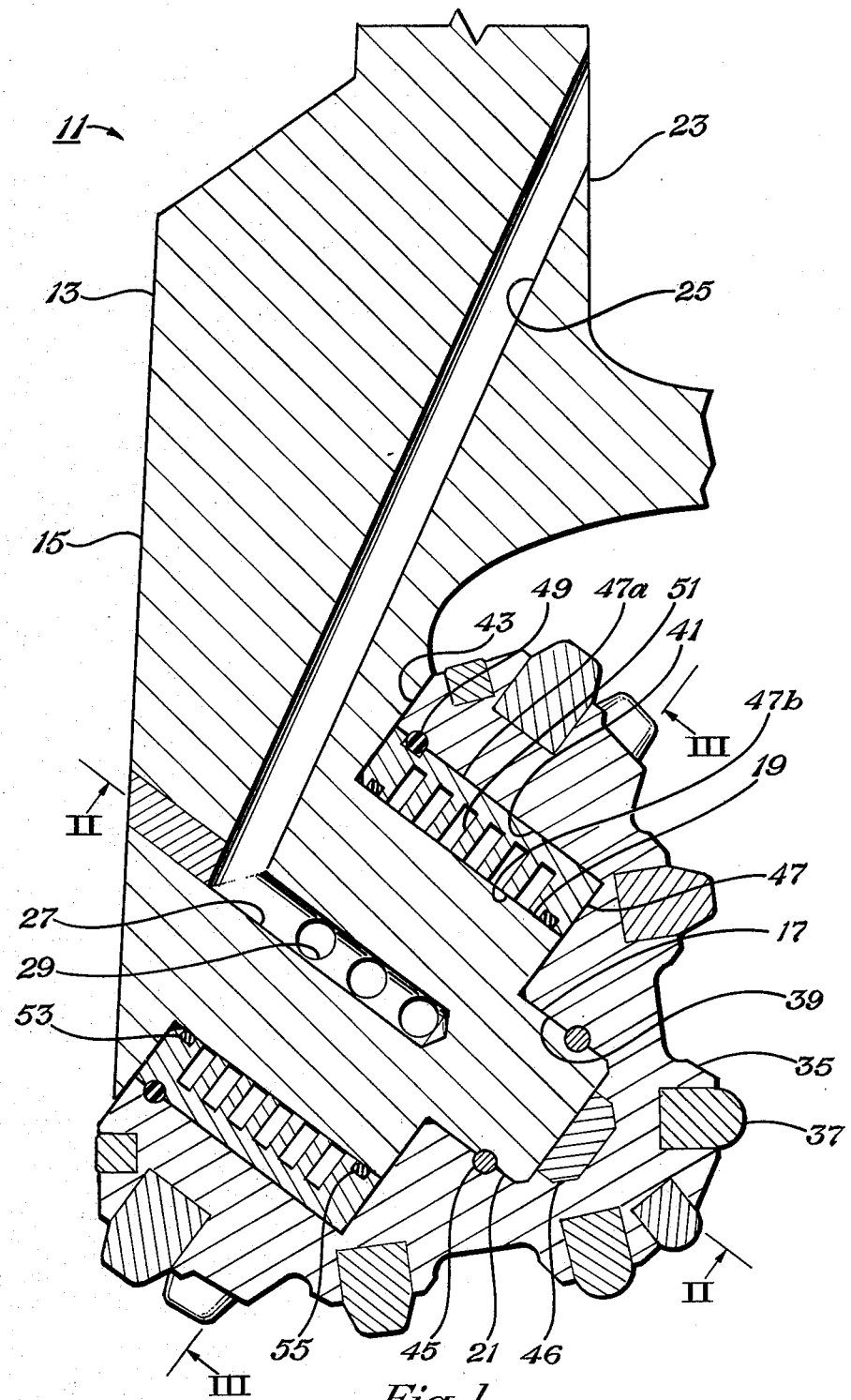
FIG. 1 is a vertical sectional view of one-third of a drill bit constructed in accordance with this invention.

Referring to FIG. 1, drill bit 11 has three head sections 13 (only one shown) that are subsequently welded together to define the body of the drill bit. A bit leg 15 depends from each head section 13. A generally cylindrical bearing pin 17 extends downwardly and inwardly from each bit leg.

In the preferred embodiment, bearing pin 17 has an enlarged cylindrical portion 19 that joins the inside surface of bit leg 15. A reduced diameter cylindrical portion 21 is formed on the free end of bearing pin 17. Drill bit 11 has a central axial passage 23 that extends downwardly. Axial passage 23 has three outlets leading to nozzles (not shown) for discharging a portion of the drilling fluid being pumped down the drill string. A fluid transmitting passage 25 for each head section 13 has its entrance in axial passage 23 and terminates at the base of the bearing pin 17. A fluid transmitting passage 27 extends from passage 25 into the bearing pin 17 parallel with the axis of the bearing pin. Passage 27 is drilled from the outer surface of the bit 11 inward, then plugged to the intersection with passage 25. Three transmitting passages 29 extend outward from the passage 27 to the cylindrical surface of the bearing pin enlarged portion 19. As shown also in FIGS. 2 and 3, passages 29 have axes that lie in the same plane and are perpendicular to the axis of passage 27.

Figure 2:
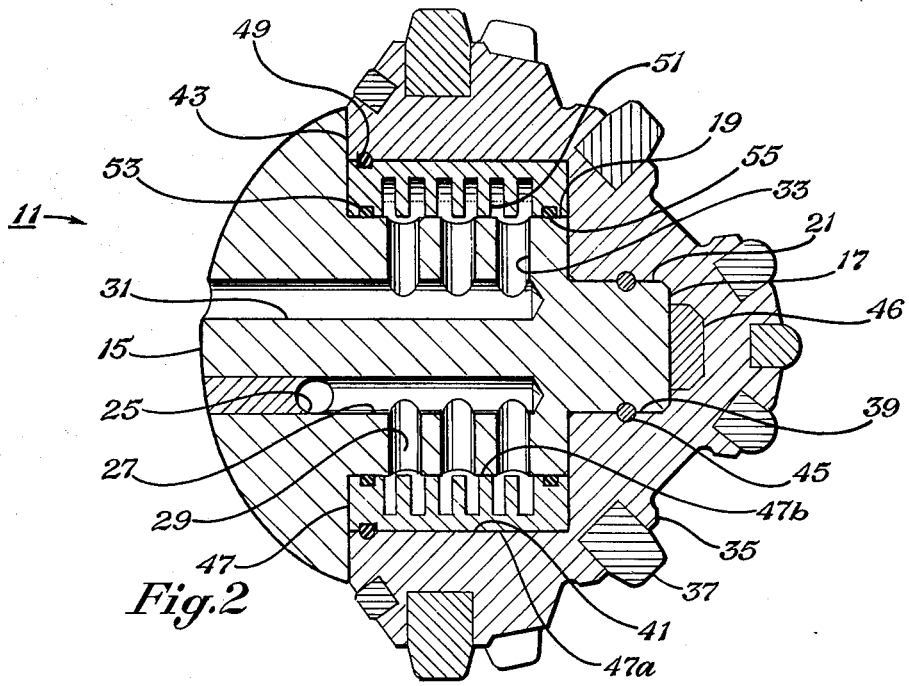
FIG. 2 is a sectional view taken along the line II—II of FIG. 1.
Figure 3:
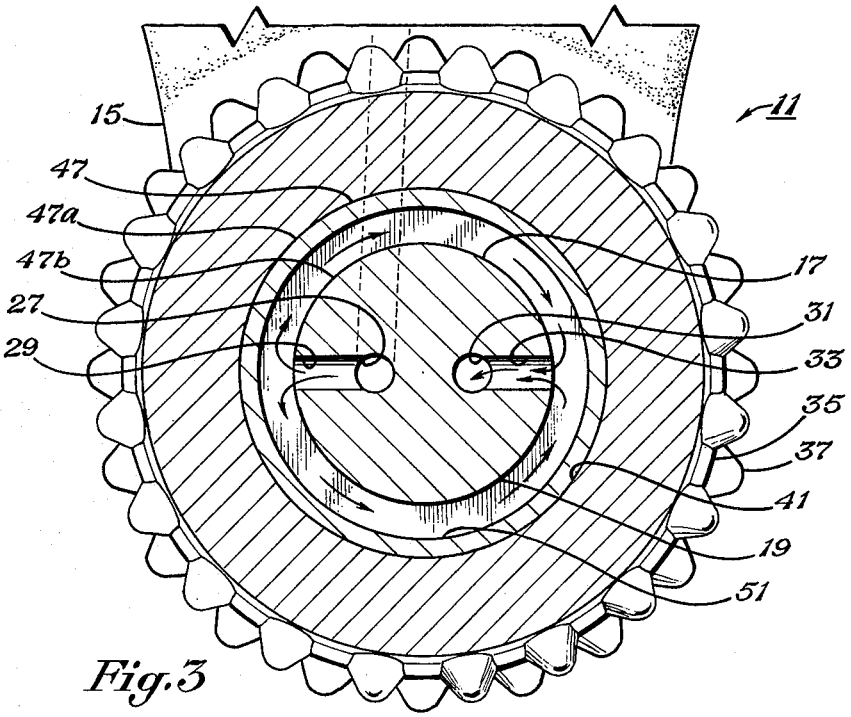
FIG. 3 is a sectional view of the drill bit of FIG. 1, taken along the line III—III of FIG. 1.

Referring to FIG. 2, a fluid discharging passage 31 extends through the bearing pin 17 and has an outlet at the exterior of the bit leg 15. Discharge passage 31 has an axis that is also parallel with the axis of the bearing pin, but it is offset from the bit axis at a point 180 degrees from the passage 27. Three inlet passages 33 extend from discharge passage 31 to the outer surface of the bearing enlarged portion 19. The axes of passages 33 all lie in the same plane that contains the axes of passages 29, and are perpendicular to the axis of discharge passage 31.

Referring again to FIG. 1, a cutter 35 is mounted on bearing pin 17. Cutter 35 has a generally conical exterior with a plurality of cutting elements. In the embodiment of FIG. 1, the cutting elements comprise hard metal inserts 37, such as tungsten carbide, inserted into holes in the cutter 35. Cutter 35 has a central cavity with a cylindrical reduced diameter portion 39 at the small end. A cylindrical enlarged diameter portion 41 extends from the backface 43 of the cutter to the reduced portion 39. The reduced portion 39 fits in rotating and sliding contact on the bearing pin reduced portion 21, forming a friction or journal bearing. A metal snap or retaining ring 45 is located in grooves in the reduced portions 21 and 39 for retaining the cutter on the bearing pin 17. Retaining ring 45 and the mating grooves are constructed as taught in U.S. Pat. No. 4,236,764, Edward M. Galle, issued Dec. 2, 1980. A nose button 46 is located in the base of reduced diameter portion 39 for absorbing thrust.

The cutter enlarged portion 41 is larger in diameter than the bearing pin enlarged portion 19, and receives within it a metal bushing 47. Bushing 47 has a cylindrical outer surface **47*a* that frictionally engages in rotating and sliding contact the cutter cavity portion 41. Surfaces 47*a* and 41 form a journal bearing. Lubricant located in the two journal bearing areas is sealed by an O-ring 49 located next to the backface 43. Bushing 47 has an inner surface 47*b* that is tightly pressed onto the bearing pin enlarged portion 19. This causes bushing 47 to be stationarily fixed to bearing pin 17. Six parallel circumferential grooves 51 are formed in the inner surface 47*b* of bushing 47. Grooves 51 extend completely around the inner surface of bushing 47, and are closely spaced so as to define relatively thin fins between them. The grooves 51 have a depth that is greater than one-half the thickness of the bushing 47**.

An O-ring 53 is located between the bushing inner surface **47*b* and the bearing pin portion 19 near the backface 43 on the outward side of grooves 51. An O-ring 55 is located on the inward side of grooves 51 between the bushing inner surface 47*b* and the bearing portion 19 near the junction with the bearing pin portion 21**.

In operation, lubricant will be placed in the cutter cavity and sealed by O-ring 49. The bit will be lowered into the well and rotated. As the bit rotates, cutter 35 will rotate with respect to bushing 47 and bearing pin 17. Cooling or drilling fluid such as air will be pumped down the drill string, down bit passage 23, and fluid transmitting passages 25, 27 and 29. The cooling fluid will exit passages 29 and flow through the grooves 51 of bushing 47. The fluid will flow, as shown by the arrows in FIG. 3, from the discharge passages 29 to the return passages 33 on the opposite side. Fluid will flow up the return passages 33 and out passage 31 to the exterior of the bit, then up the well. The cooling fluid removes heat generated between the bearing surfaces 19 and 41 to lengthen the life of the bearing and seal.

Bearing pin 17 and bushing 47 cooperate to serve as shaft means for rotatably carrying cutter 35 in sliding frictional contact to form a journal bearing. Passages 25, 27, 29, 31 and 33 serve as passage means for circulating cooling fluid through the grooves. More specifically, passages 25, 27 and 29 serve as transmitting passage means for supplying coolant fluid to the grooves. Passages 31 and 33 serve as exit passage means for discharging the coolant fluid. O-ring 49 serves as lubricant seal means for sealing lubricant within spaces between the cutter 35 and bushing 47. O-rings 53 and 55 serve as cooling fluid seal means for sealing the cooling fluid from the lubricant.

The invention has significant advantages. The grooves and cooling fluid passages provide a means for removing heat from a journal bearing. Providing the cooling at a point very near the journal bearing surfaces, rather than only on the exterior of the bit, should allow the bearing to remain cooler and thus lengthen the life of the bit.

While the invention has been shown in only one of its forms, it should be apparent to those skilled in the art that it is not so limited but is susceptible to various changes and modifications without departing from the spirit of the invention. For example, the grooves could be located in the bearing pin surface, rather than in the bushing surface.

I claim:

1. In an earth boring bit of the type having rotatable cutters carried by depending bearing pins, an improved bearing means for each cutter, comprising:
   - a bushing having an inner surface in stationary contact with an outer surface of the bearing pin;
   - one of said surfaces having a plurality of grooves; and
   - passage means formed in the bearing pin and bit for circulating cooling fluid through the grooves;
   - the cutter being mounted on the bushing in rotating and sliding contact to form a journal bearing; and
   - seal means for sealing the cooling fluid from the journal bearing.

2. In an earth boring bit of the type having rotatable cutters carried by depending bearing pins, an improved bearing means for each cutter comprising:
   - a bushing having an inner surface in stationary contact with an outer surface of the bearing pin;
   - one of said surfaces having a plurality of circumferential grooves;
   - passage means formed in the bearing pin and bit for circulating cooling fluid through the grooves;
   - the cutter being mounted on the bushing in rotating, sliding contact; and
   - lubricant seal means between the bushing and cutter for sealing lubricant within spaces between the cutter and bushing.

3. In an earth boring bit of the type having rotatable cutters carried by bearing pins, each bearing pin depending from a bit leg of a head section, an improved bearing means for each cutter, comprising:
   - a bushing having an inner surface in stationary contact with an outer surface of the bearing pin;
   - one of said surfaces having a plurality of grooves extending at least partially around the bearing pin;
   - transmitting passage means extending through the bit with an outlet at the grooves for supplying cooling fluid to the grooves;
   - exit passage means extending through the bit with an inlet at the grooves opposite said outlet and an outlet at the bit leg for discharging the cooling fluid;
   - the cutter being mounted on the bushing in rotating, sliding contact;
   - lubricant seal means between the bushing and cutter for sealing lubricant within spaces between the cutter and bushing; and
   - cooling fluid seal means for sealing the cooling fluid from the lubricant.

4. In an earth boring bit of the type having three head sections, each with a bit leg having a depending bearing pin having a reduced diameter portion on a free end and an enlarged diameter surface joining the head section, each bearing pin carrying a cutter with a cavity having a reduced diameter portion and an enlarged diameter portion, the improvement comprising:
   - a bushing having an inner surface in stationary contact with the enlarged diameter surface of the bearing pin;
   - one of said surfaces having a plurality of grooves extending circumferentially around the bearing pin;
   - transmitting passage means extending through the bit and bearing pin with outlets at the grooves for supplying cooling fluid to the grooves;
   - exit passage means extending through the bit and bearing pin with inlets at the grooves opposite said outlets, and outlets at the exterior of the bit leg, for discharging the cooling fluid;
   - the cutter having its enlarged diameter portion in sliding, rotating contact with an outer surface of the bushing;
   - lubricant seal means next to the entrance of the cavity for sealing lubricant within the cavity of the cutter; and
   - cooling fluid seal means located both on inward and outward sides of the grooves between the bearing pin enlarged diameter surface and the bushing, for sealing the cooling fluid from the lubricant.

5. In an earth boring bit of the type having rotatable cutters carried by depending bearing pins, an improved bearing means for each cutter, comprising:
   - a bushing having a cylindrical inner surface containing a plurality of circumferential grooves, the bushing being mounted stationarily on the bearing pin and having an outer surface that is cylindrical; and
   - passage means formed in the bearing pin and bit for circulating cooling fluid through the grooves;
   - the cutter having a cavity with a cylindrical surface that mates with the bushing outer surface in rotating, sliding contact to form a journal bearing and
   - seal means for sealing the cooling fluid from the journal bearing.

6. In an earth boring bit of the type having rotatable cutters carried by bearing pins, each of which depend from a bit leg an improved bearing means for each cutter, comprising:
   - a bushing carried between the bearing pin and the cutter, the bushing having an outer surface in sliding frictional contact with the cutter, forming a journal bearing;

passage means formed in the bit leg, bearing pin, and bushing for circulating cooling fluid through the bushing and out of the bit leg; and lubricant seal means between the bushing and cutter for sealing from the cooling fluid lubricant within the journal bearing.

7. In an earth boring bit of the type having shaft means for rotatably carrying a cutter in sliding, frictional contact to form a journal bearing, the improvement comprising:

passage means for circulating cooling fluid internally through the shaft means and to discharge from the bit without contacting the journal bearing, the passage means including a plurality of individual cooling fluid passages spaced apart from each other and located at least partially around the shaft means.

8. In an earth boring bit of the type having shaft means depending from a bit leg for rotatably carrying a cutter in sliding, frictional contact to form a journal bearing, the improvement comprising:

transmitting passage means for circulating cooling fluid into the shaft means;

a plurality of identical spaced apart cooling passages located at least partially around the shaft means, each having an inlet in communication with the transmitting passage means and an outlet; and exit passage means, extending out the bit leg from the outlets of the cooling passages for discharging the cooling fluid.

* * * * *

UNITED STATES PATENT AND TRADEMARK OFFICE

CERTIFICATE OF CORRECTION

PATENT NO. : 4,386,663

DATED : June 7, 1983

INVENTOR(S) : Rodolfo M. Ippolito

It is certified that error appears in the above-identified patent and that said Letters Patent is hereby corrected as shown below:

Cover page, under "References Cited", the following should be inserted:

3,964,554 6/1976 Ricks

Signed and Sealed this

*Twenty-ninth* Day of *November 1983*

[SEAL]

*Attest:*

GERALD J. MOSSINGHOFF

*Attesting Officer*

*Commissioner of Patents and Trademarks*